US010287786B2

(12) United States Patent
Gurtler et al.

(10) Patent No.: US 10,287,786 B2
(45) Date of Patent: May 14, 2019

(54) FALL ARREST ANCHOR

(71) Applicant: METRO SAFETY RAIL INCORPORATED, Calgary (CA)

(72) Inventors: Dean Gurtler, Calgary (CA); Dale Kermociev, Calgary (CA)

(73) Assignee: Metro Safety Rail Incorporated, Calgary (CA)

( * ) Notice: Subject to any disclaimer, the term of this patent is extended or adjusted under 35 U.S.C. 154(b) by 0 days.

(21) Appl. No.: 15/818,709

(22) Filed: Nov. 20, 2017

(65) Prior Publication Data

US 2018/0142481 A1 May 24, 2018

Related U.S. Application Data

(60) Provisional application No. 62/425,066, filed on Nov. 21, 2016.

(51) Int. Cl.

| | |
|---|---|
| ***E04G 21/32*** | (2006.01) |
| ***A62B 35/00*** | (2006.01) |
| ***E04C 5/02*** | (2006.01) |
| ***E04C 5/20*** | (2006.01) |
| ***E04H 12/22*** | (2006.01) |

(52) U.S. Cl.

CPC ..... *E04G 21/3223* (2013.01); *A62B 35/0056* (2013.01); *A62B 35/0068* (2013.01); *E04C 5/02* (2013.01); *E04C 5/20* (2013.01); *E04H 12/2269* (2013.01)

(58) Field of Classification Search

CPC ..... E04G 21/3223; E04C 5/20; E04C 5/02; E04C 5/166; E04H 12/2269; E04H 12/22; A62B 35/0068

USPC ..... 52/125.6, 296

See application file for complete search history.

(56) References Cited

U.S. PATENT DOCUMENTS 5,203,817 A * 4/1993 Klumpjan ..... E04H 12/2276 256/19

2014/0299829 A1* 10/2014 Herman ..... B23K 31/02 256/46

* cited by examiner

*Primary Examiner* — Patrick J Maestri

(74) *Attorney, Agent, or Firm* — Sander R. Gelsing

(57) ABSTRACT

A post anchor is provided for securing a post within a poured concrete slab. The post anchor comprises a socket having a first cavity sized to receive the post therein. A jacket member is adapted to mount over at least a portion of the socket. At least one tensile member is mounted to, and extending from, the jacket member. The jacket and tensile members function to reinforce the socket and to distribute any forces exerted upon the post anchor further into the surrounding concrete. The socket may be provided in a variety of heights, to allow the post anchor to be easily adapted to a variety of slab depths.

2 Claims, 13 Drawing Sheets

FALL ARREST ANCHOR

CROSS REFERENCE TO RELATED APPLICATION

This application is a non-provisional application which claims priority to, and benefit of, U.S. Provisional Patent Application Ser. No. 62/425,066 filed Nov. 21, 2016 and entitled, "FALL ARREST ANCHOR", the entirety of which is incorporated herein by reference.

FIELD

This invention relates generally to fall arrest systems and anchors. More particularly, the invention relates to an anchoring socket insert that may be embedded within a concrete structure.

BACKGROUND

Fall arrest devices are commonly used by persons working at height which would be dangerous if that person was to fall from such a height. One common type of fall arrest device is an anchor which is used to secure one end of a rope or the like which is also secured to the person at the other end. Such anchors may be formed of a post which may be independent of or formed integrally with another barrier member.

Many fall arrest posts have been commonly secured to a top surface of a concrete slab or the like. Such posts, require fastening to the concrete slab which requires permanently securing the post to the concrete slab by fasteners such as anchor bolts. Disadvantageously, drilling and securing an anchor bolt into a previously formed concrete slab is known to potentially cause damage to the concrete slab, including the reinforcing bars. Furthermore, damage to the concrete slab or inadvertently exposing a reinforcing bar by drilling expose the reinforcing bars to adverse weather which may therefore make them prone to oxidization and further degradation. An example of such a system may be found at U.S. Pat. No. 6,695,095 issued Feb. 24, 2004 to Franke.

In many locations it is also undesirable to leave barriers in place when not in use. In such locations, it has become common practice to provide a hole or socket into which the anchor post is inserted for use. Conventional post sockets have not adequately provided the desired level of a secure support for fall arrest anchors. In particular, some previous attempts have been to provide a cup or sleeve inserted in to the concrete slab. Such cups however have lacked sufficient surface area to provide an adequate level of pull out resistance for high loads placed upon the fall arrest anchor. Examples of such inserts may be found in U.S. Pat. No. 3,712,014 issued Jan. 23, 1973 to Waerner. Such embedded anchoring sockets often do not provide sufficient reinforcement when placed under a typical load (e.g. a cable force of as little as 1 kN). These conventional embedded sockets, when placed under load, will either crack and damage the surrounding concrete structure (in which they are embedded) or pullout entirely from the concrete, thereby creating a safety hazard.

Other designs have attempted to provide anchor rods extending from the insert cup to increase the surface area provided by embedded socket and thereby spread the resulting force over a larger portion of the concrete slab so as to provide a larger pull out strength. Examples of such designs may be found at U.S. Pat. No. 4,179,151 issued Dec. 18, 1979 to Tye. Such designs have limited lateral strength to resist torques or bending rotations of the fall arrest post due to the construction of the plastic material utilized in such apparatus as well as locating the anchoring rods at the bottom portion of the apparatus only.

Finally, it is known that concrete slabs or concrete structures (in which such anchoring sockets may be embedded) or often of different depths or thicknesses. Conventional embedded anchoring sockets are typically designed at a set size and would require to be offset (height-wise) within the concrete structure, to ensure that the top of such socket still corresponds to the top of the concrete structure.

Therefore what is needed is a fall arrest system and anchoring socket that does not suffer from the above-noted disadvantages.

SUMMARY OF THE INVENTION

According to a first embodiment of the present invention there is provided a post anchor for securing a post within a poured concrete slab. The post anchor comprises a socket having a first cavity sized to receive the post therein. A jacket member is adapted to mount over at least a portion of the socket. At least one tensile member is mounted to, and extending from, the jacket member. The tensile members function to reinforce the socket and to distribute any forces exerted upon the post anchor further into the surrounding concrete. The socket may be provided in a variety of heights, to allow the post anchor to be easily adapted to a variety of slab depths.

Other aspects and features of the present invention will become apparent to those ordinarily skilled in the art upon review of the following description of specific embodiments of the invention in conjunction with the accompanying figures.

DESCRIPTION

Figure 1:
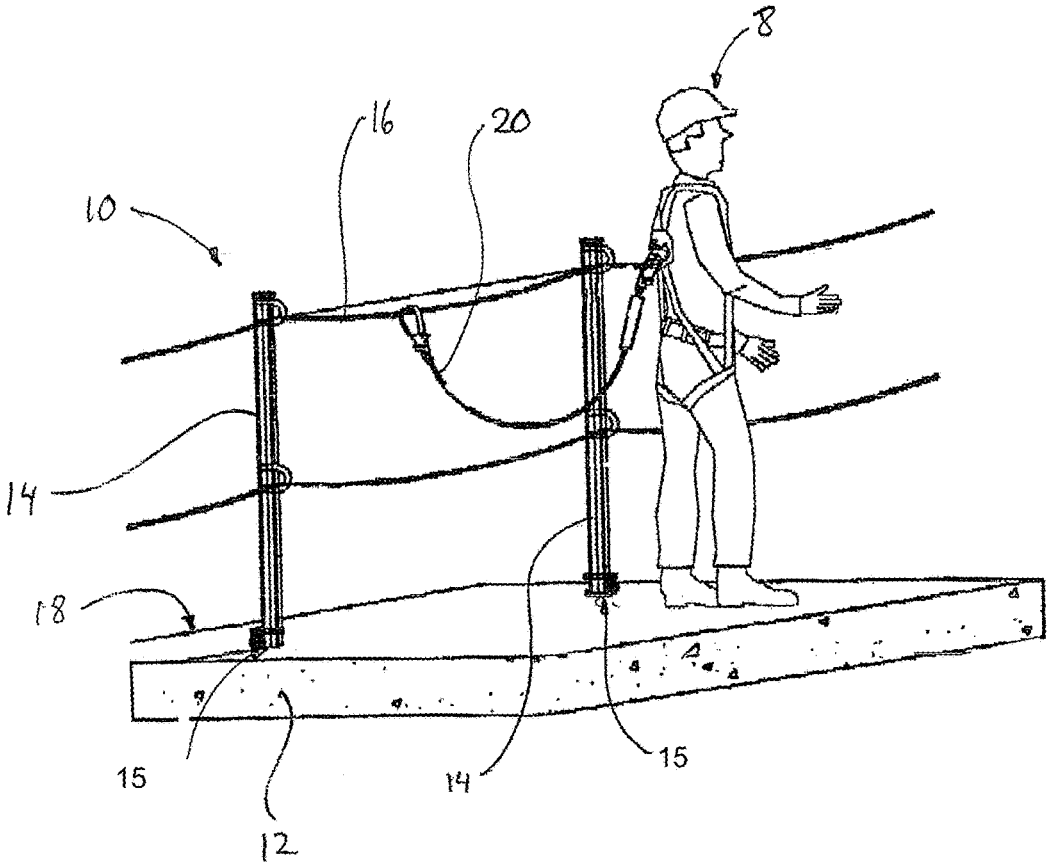
FIG. 1 is a perspective view of a fall arrest fence having a plurality of fall arrest posts secured to a concrete slab in an apparatus according to a first embodiment of the present invention.

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

Referring to FIG. 1, a fall arrest barrier 10 is formed above a concrete slab 12. The fall arrest barrier 10 is formed of at least one fall arrest post 14 supported by the concrete slab 12 and optionally at least one cable or rope 16 extending between a plurality of fall arrest posts 14. The at least one fall arrest post 14 may be located proximate to an edge 18 of the concrete slab 12 and secured therein with a post anchor 15 according to an embodiment of the invention. As illustrated, a user 8 may be secured to the rope 16 and/or fall arrest post 14 by a tether 20 or the like as are commonly known in the art.

Figure 2:
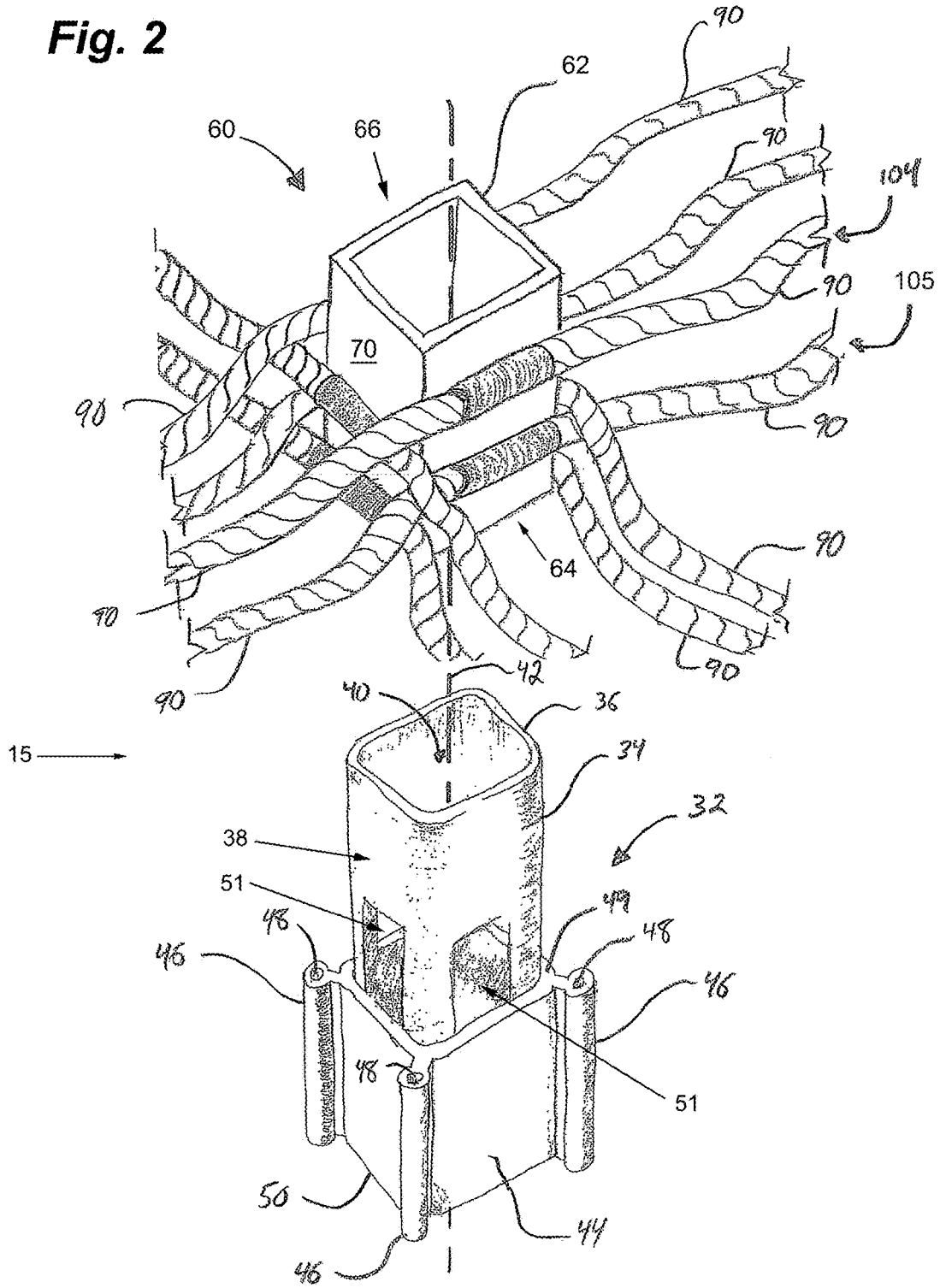
FIG. 2 is an exploded perspective view of an apparatus for securing a fall arrest post within a poured concrete slab according to a first embodiment of the present invention.
Figure 3:
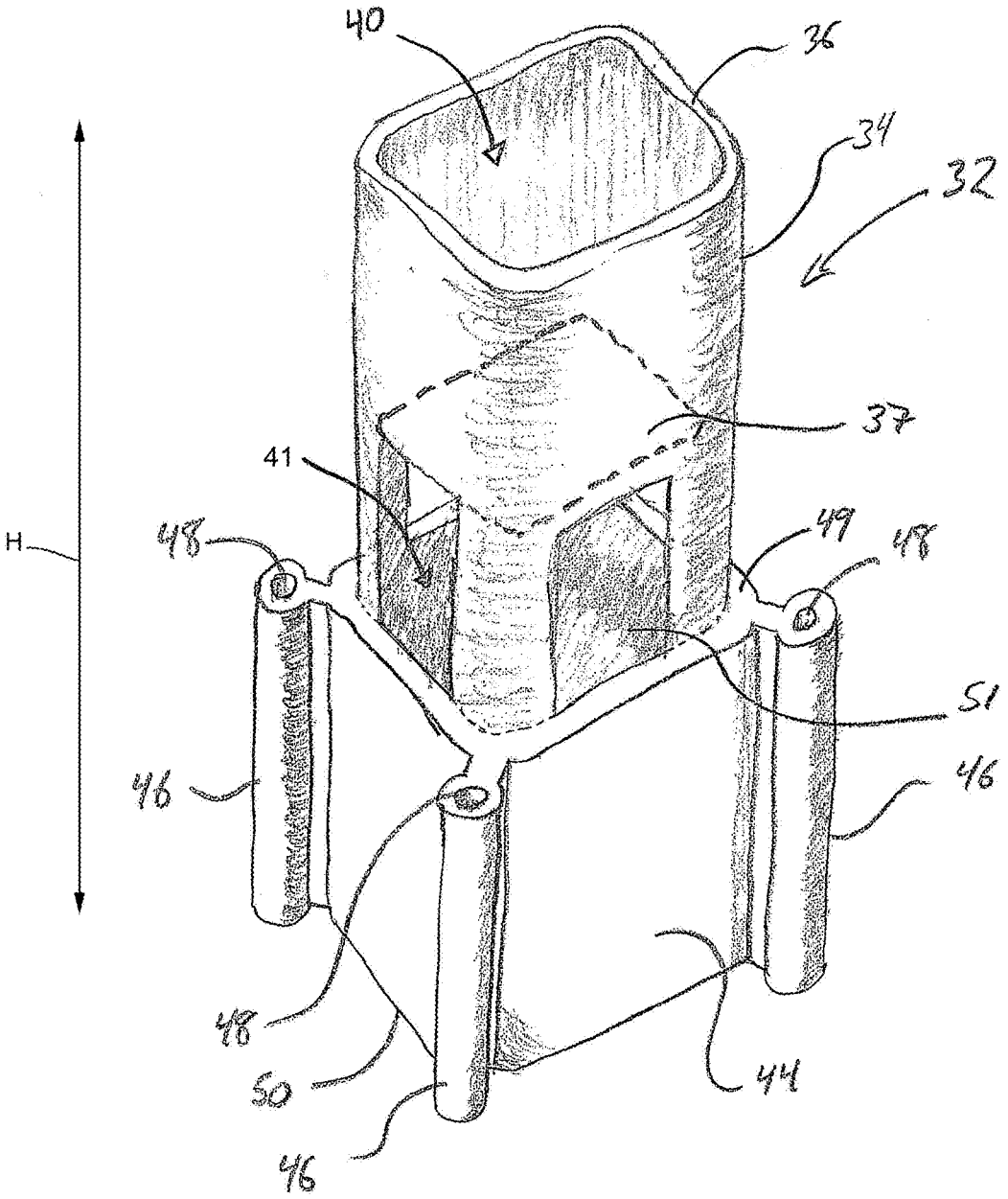
FIG. 3 is a perspective view of a socket of an embodiment of the present invention.
Figure 4A:
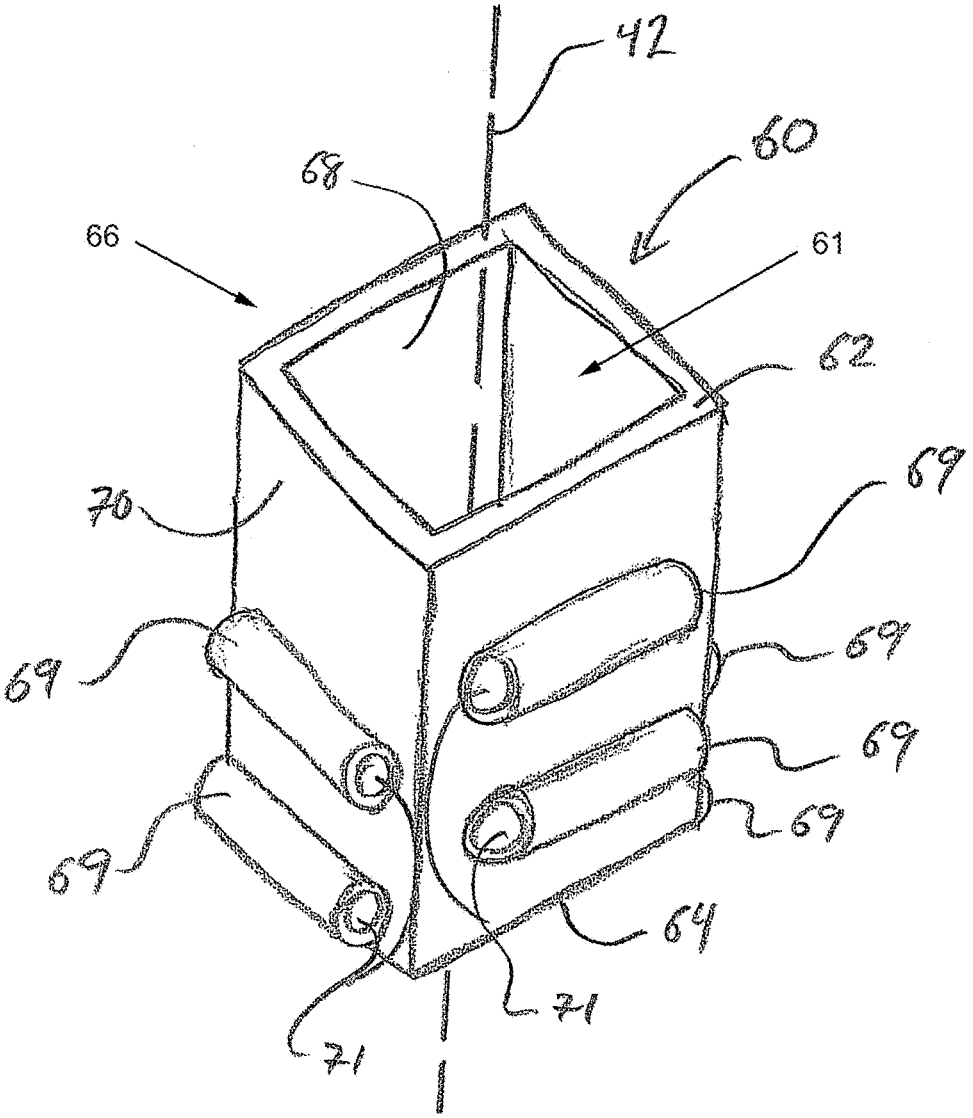
FIG. 4*a* is a perspective view of an jacket member of an embodiment of the present invention.
Figure 4B:
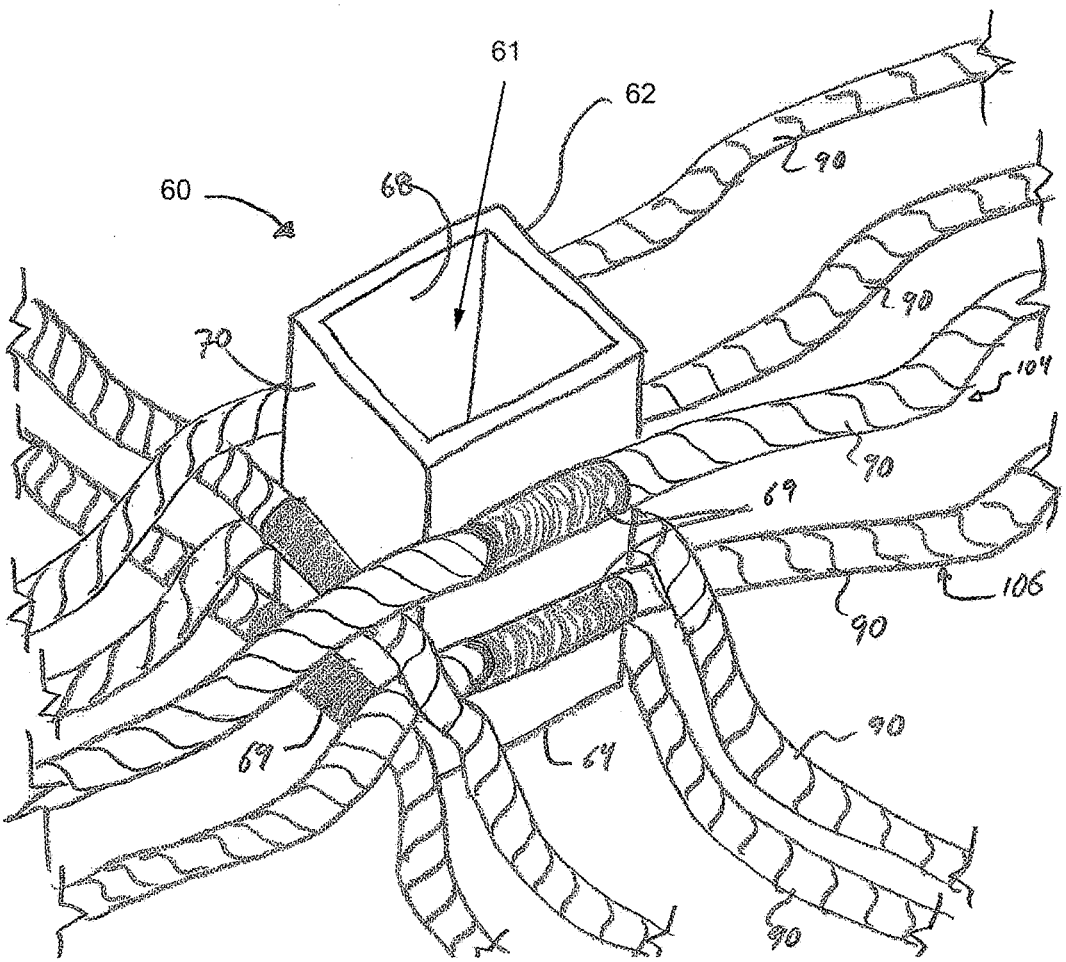
FIG. 4*b* is a perspective view of the jacket member of FIG. 4*a* having elongate members extending therefrom.
Figure 4C:
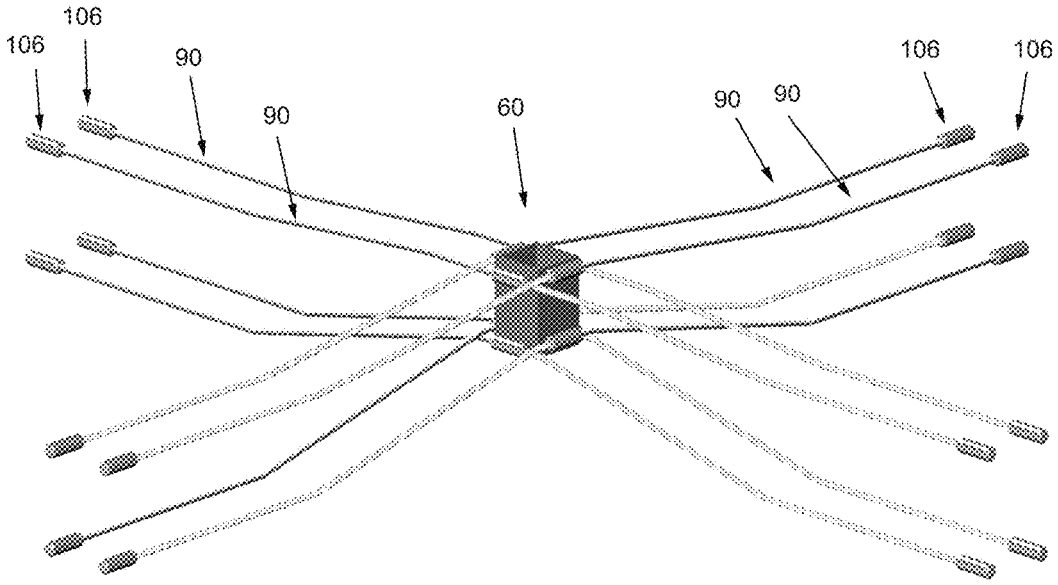
FIG. 4*c* is a perspective view of another embodiment of a jacket member having elongate members extending therefrom.

Turning now to FIGS. 2 and 3, an exploded view of an embodiment of the post anchor 15 is illustrated and comprises a socket 32 (adapted to receive a post 14 therein), a jacket member 60 (adapted to slidably mount over at least a portion of the socket 32), and at least one tensile member 90 mounted to and extending from the jacket 60.

The socket 32 preferably comprises a sleeve portion 34 and a base portion 44. The sleeve portion 34 includes a top end 36 of the socket 32 and is preferably formed of a continuous wall 38 defining a first central cavity 40 therein extending from the top end 36 to a floor 37 spaced from the top end 36 for supporting a fall arrest post 14 thereon. First central cavity 40 extends along a central or longitudinal axis 42 of the socket 32 and preferably has a shape and internal dimensions adapted to accept a fall arrest post 14 therein. As illustrated in FIG. 3, a second central cavity 41 may be provided between the floor 37 and a bottom end 50 of the base portion 44.

The base portion 44 preferably comprises a shoulder 49 between the floor 37 and bottom end 50. More preferably, between the floor 37 and the shoulder 49, at least one opening 51 is provided through the sleeve portion 34 to the second central cavity 41 for accepting concrete or cement therethrough. Advantageously, by allowing concrete or cement to enter the second central cavity 41 during installation of the socket 32 within a concrete slab 12, post anchor 15 will be securely mounted within such slab 12.

More advantageously, by providing jacket member 60 which is mountable over the socket 32, the socket may be first independently secured into the slab 12, after which jacket member 60 and tensile members 90 may be mounted thereover and the tensile members 90 may then be positioned within the concrete (or to any rebar) as desired. The slab 12 may be poured in stages, e.g. a first stage wherein the second cavity 41 is filled by concrete and socket 32 is secured into the slab 12, and a second stage where jacket member 60 is mounted over the sleeve portion 34 (which is still projecting out of the first stage of slab 12) and wherein the tensile members 90 are positioned as desired (e.g. adjacent to rebar), after which the remainder of the slab 12 is poured.

Figure 6:
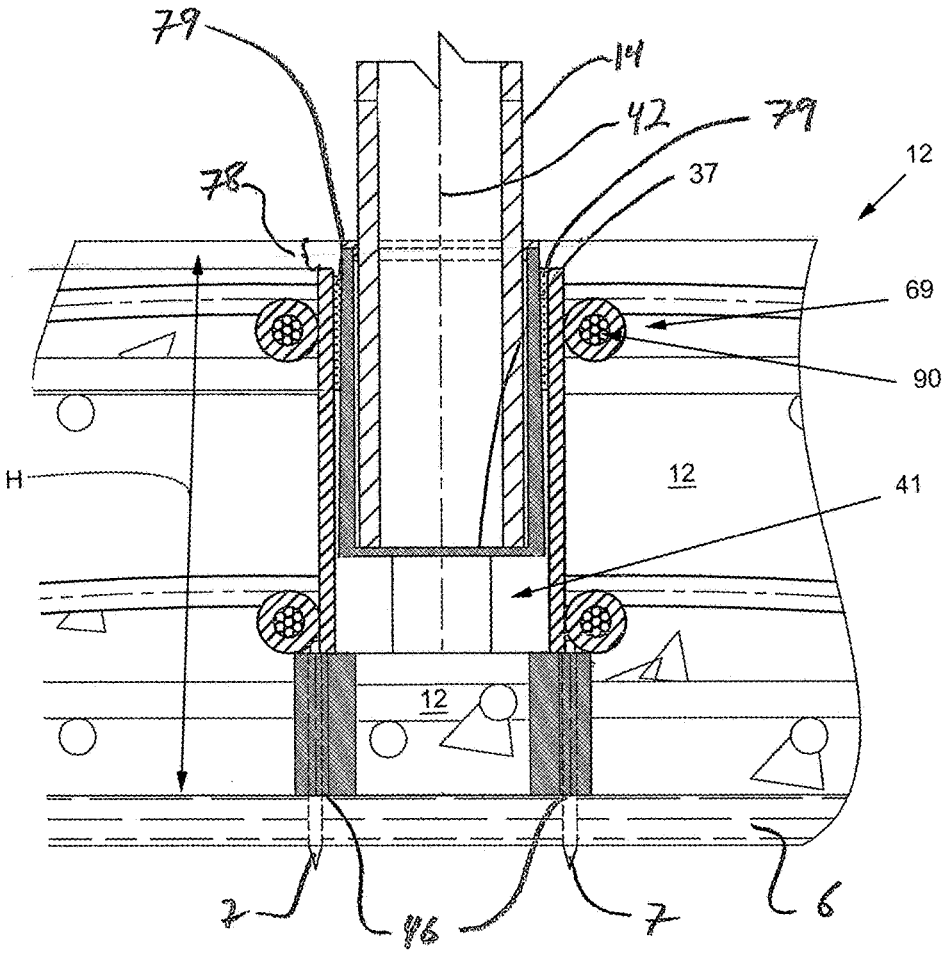
FIG. 6 is a cross sectional view of the apparatus of FIG. 5 embedded within a concrete slab with a fall arrest post secured therein as taken along the line A-A' of FIG. 5.

As illustrated in FIG. 6, the floor 37 provides a limit to the amount that a fall arrest post 14 may be inserted into the central cavity 40 via top end 36. The first central cavity 40 is preferably sized to receive the fall arrest post 14 therein in a friction fit, so as to retain the fall arrest post therein and upon the mid-floor 37, such as by way of non-limiting example in an interference fit. In particular, the first central cavity 40 may be substantially rectangular with rounded corners or any other shape as desired by a user or dictated by the shape of the fall arrest posts 14.

Figure 10A:
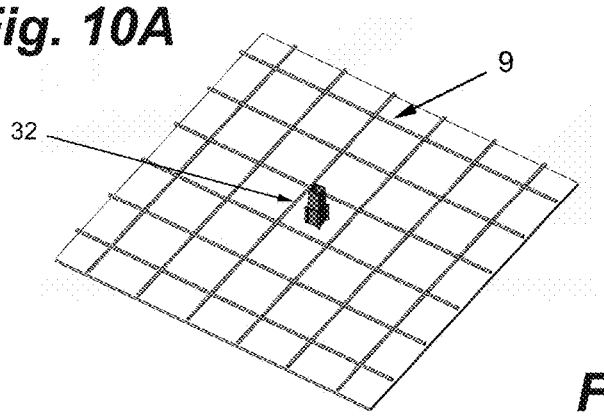
FIGS. 10A-10D are perspective views of a preferred embodiment of the post anchor shown being installed into a concrete slab between sets of reinforcing bars.
Figure 10B:
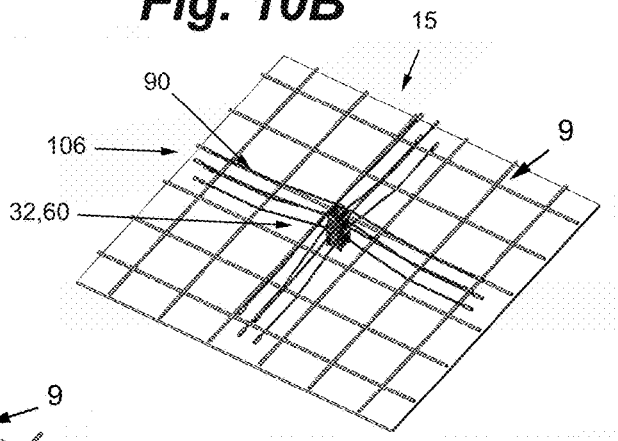
Figure 10C:
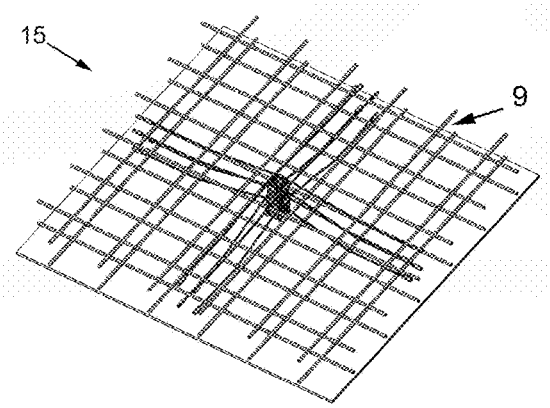
Figure 10D:
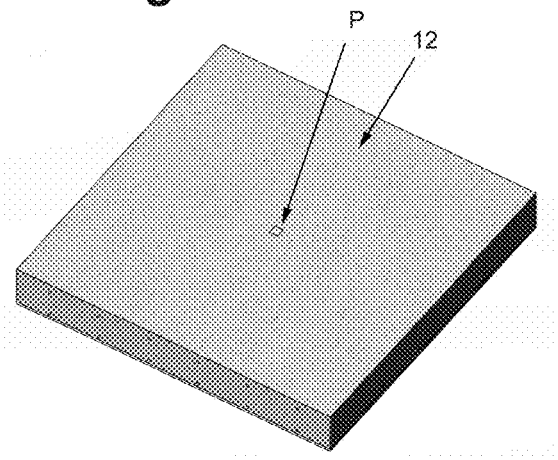

As can also be seen in FIG. 6, floor 37 and wall 38 cooperate to prevent any concrete or cement (that may be present during installation of the socket 32 into a slab 12) from entering the first central cavity 41. It will be appreciated that an optional plug P (as are commonly known) may be utilized to seal off the top end 36 and cooperate with the floor 37 and wall 38 so as to keep the first inner cavity 40 free of concrete during pouring of the concrete slab 12, and/or to keep any dirt, elements or other unwanted materials from entering the first central cavity 41 when a post is not installed therein (see FIG. 10D). After pouring of a concrete slab 12 around a socket 32, such a plug may be removed, thereby providing access to the first central cavity 40.

The base portion 44 preferably comprises an outer shape which substantially corresponds to the outer shape of the sleeve portion 34 and terminates at the bottom end 50. The base portion 44 further comprises at least one radial member 46 extending radially therefrom and having a bore 48 suitable to accept a fastener 7 therethrough (see FIG. 6). The bores 48 preferably extend to the bottom end 50 of the base portion 44 and are sized to have fasteners 7, such as nails, screws or the like passed there through so as to fasten the socket 32 to a bottom form, prior to pouring of any concrete or cement, as will be further discussed below. Bores 48 may have an axis that is substantially parallel to longitudinal axis 42 of the socket 32. However, as will be now be appreciated by those skilled in the art, radial members 46 may also be shaped differently, such as planar tabs without bores, but suitable to accept a fastener mounted therethrough.

The socket 32 may be formed of a water resistant and non-oxidizing material, such as plastics, ceramics or non-corrosive metals, such as stainless steel, aluminum, brass and alloys thereof. In particular, the socket 32 may be formed of any suitable plastic such as, by way of non-limiting example, polyvinyl chloride (PVC), polyethylene, (PE), polycarbonate, cellulose acetate, acrylonitrile butadiene styrene (ABS), or acrylic. The socket 32 may be formed of any suitable process, such as injection molding, machining, and welding, with adhesives or any other suitable process.

Figure 9:
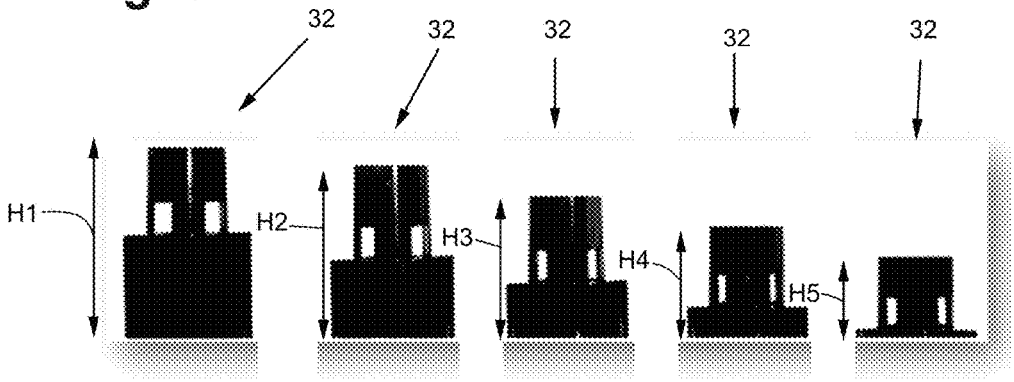
FIG. 9 is a side perspective view of a variety of socket embodiments, each having different heights.

Preferably, the socket 32 is sized to have a preset height H between the top and bottom ends 36 and 50 so as to be substantially the same height as the thickness or depth of the concrete slab 12 into which it is to be located such that the top end 36 will be located substantially along the top surface of the concrete slab 12 after forming while leaving the inner cavity 40 free of concrete. More preferably, a variety of sockets 32 with differing heights (between top 36 and bottom 50 ends) may be provided; see for example the sockets 32 in FIG. 9, having heights H1 to H5.

Advantageously, a socket 32 having a particular height (H1 to H5; e.g. see FIG. 9) may be selected depending on the depth of the concrete slab 12 that is to be poured therearound. By providing a separate socket 32 and jacket member 60, the height of the post anchor 15 can be very easily adjusted (to suit a particular desired slab 12 height) by choosing a socket 32 with the desired height (H1 to H5). Further, by providing the tensile members 90 on the jacket member 60 (instead of on the base socket 32), the socket 32 can be made from less expensive material (e.g. plastic) and be manufactured in a variety of preset heights (e.g. H1 to H5). The jacket member 60 surrounding such a socket 32 will still provide the structural strength and rigidity to allow the post anchor 15 to withstand significant forces.

Referring to FIGS. 2, 4*a*, 4*b* and 4*c*, it can be seen that the jacket member 60 comprises a bore 61 along a central or longitudinal axis 42', top and bottom ends, 62 and 64, and is adapted to slidably mount over the sleeve portion 34 of the socket 32; i.e. where sleeve portion 34 slidably fits within bore 61, and with the longitudinal axis 42, 42' of socket 32 and jacket 60 being in substantial alignment (see FIGS. 2 and 6). The jacket member 60 is preferably formed of a continuous wall 66 having inner and outer surfaces, 68 and 70, respectively. Alternatively, jacket member 60 may have a wall 66 having openings therethrough. As illustrated, the jacket member 60 may be substantially rectangular in cross-section, although it will be appreciated that other shapes may be useful as well, such as, by way of non-limiting example, square, circular, triangular, oval, octagonal or irregular.

Figure 11:
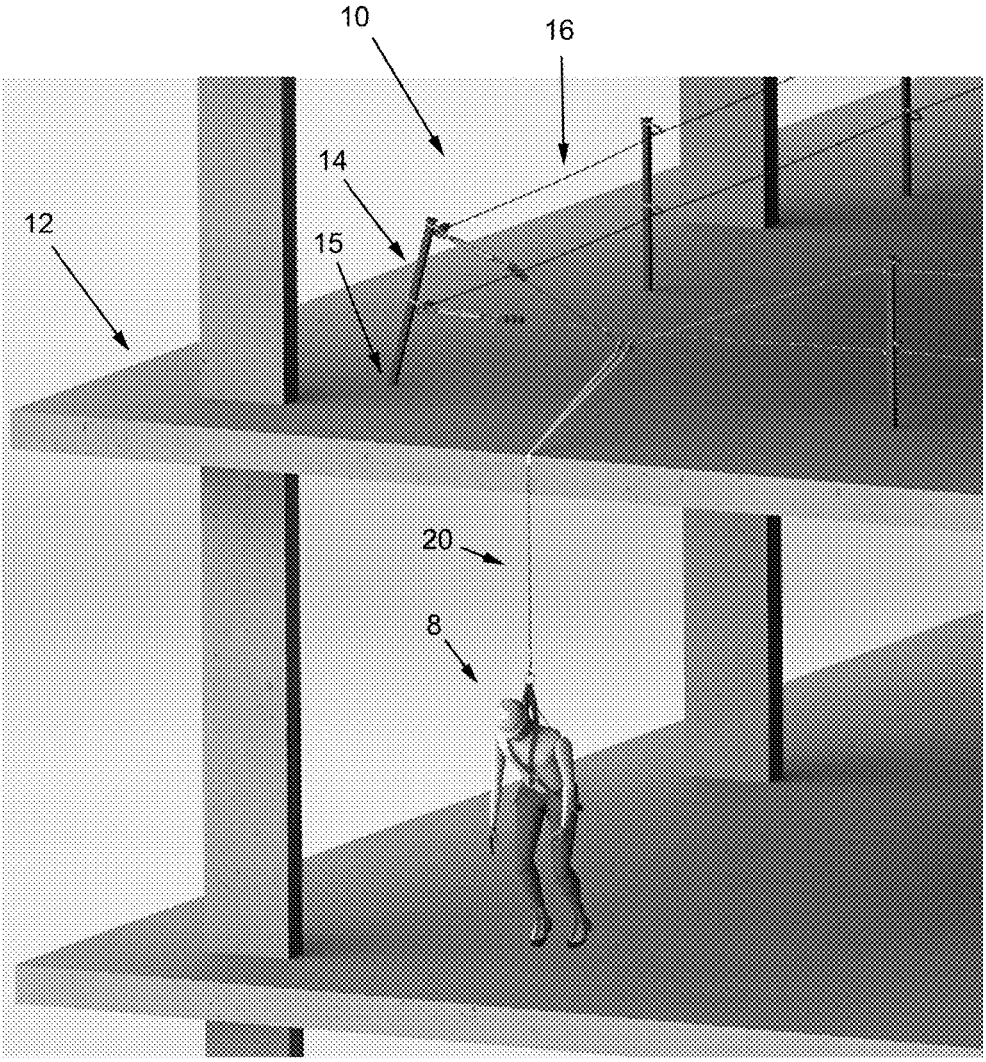
FIG. 11 is a perspective view of a fall arrest fence having a plurality of fall arrest posts secured to a concrete slab in an apparatus according to an embodiment of the present invention and showing a user suspended therefrom.

The jacket member 60 preferably has a height between the top and bottom ends 62 and 64 so as to leave a gap, generally indicated at 78 (see FIG. 6), between the top end 62 and a top surface 13 of the concrete slab 12 as illustrated in FIG. 4. The gap 78 may be selected to be between 0.5 and 2 inches although it will be appreciated that other heights may be utilized as well. The jacket member 60 may be formed of any suitable material. In particular, the jacket member 60 may be formed of a material having sufficient strength to reinforce the concrete and the socket 32 as it is positioned therearound. In some embodiments, the jacket member may be formed of steel, stainless steel, aluminum, metal or composite material. The jacket member 60 may be formed by any conventional methods, such as molding, extrusion, welding, machining or by with adhesives. Jacket member 60 is preferably dimensioned to slide over sleeve portion 34 of socket 32 with minimal remaining clearance therebetween, thereby providing additional strength and support to socket 32 (and any post 14 end therein), should a post 14 experience an unexpected force or impact (e.g. from a user 8 falling off the concrete 12 slab and engaging the fall arrest barrier 10 (e.g. see FIG. 11). More preferably, jacket member 60 engages shoulder 49 of the base portion 44 of socket 32, when jacket member 60 is fully slid over the sleeve portion 34 (see FIG. 6). More advantageously, jacket member 60 will function to transmit forces (that may come from post 14, and through socket 32) into the surrounding concrete or rebar 9, when the fall arrest barrier 10 is engaged by a user 8 (e.g. via tensile members 90).

Referring to FIG. 2, the jacket member 60 preferably includes at least one tensile member connector 69, which may be in the form of a sleeve, connected to the outer surface 70 and preferably having a bore 71 therethrough oriented substantially perpendicular to the central axis 42. Preferably, a plurality of tensile member connectors 69 are provided at regular intervals around the exterior of jacket member 60. The tensile member connectors or sleeves 69 may be spaced along each section of wall 66 of the outer surface 70 in different planes of the sleeves 69 on adjacent walls. In the present embodiment, described herein, there are two sleeves 69 on each of the four sections of wall of the outer surface 70 of the jacket member 60. However, a person of skill in the art would recognize that any number of sleeves 69 may be used depending on the design requirement for the fall arrest barrier 10. The sleeves 69 and the bore therethrough 71 may be sized to slidably accept a suitable tensile member 90 through said bore 71 (see FIG. 2).

Figure 7:
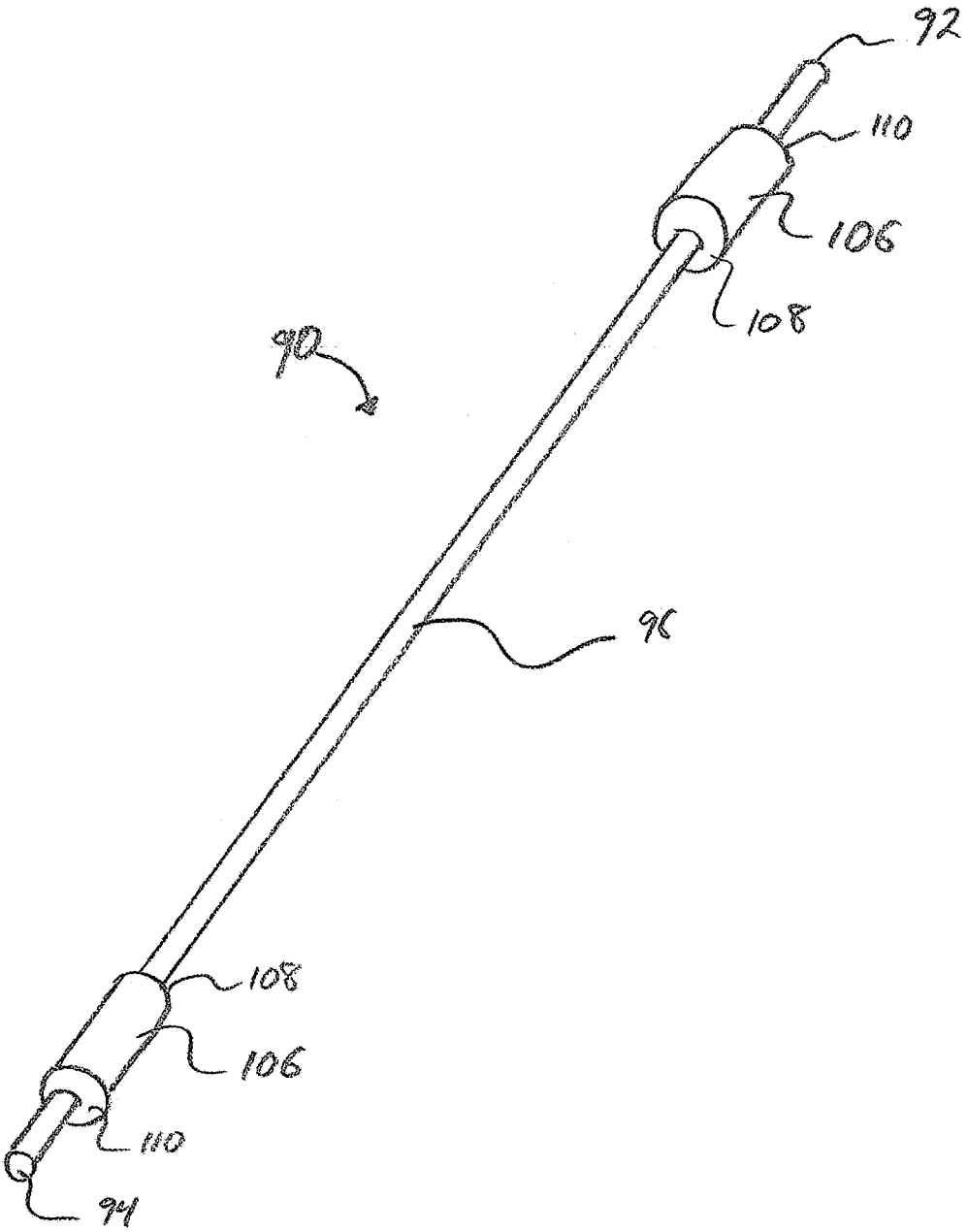
FIG. 7 is a perspective view of an elongate member of the embodiment of FIG. 2.
Figure 8:
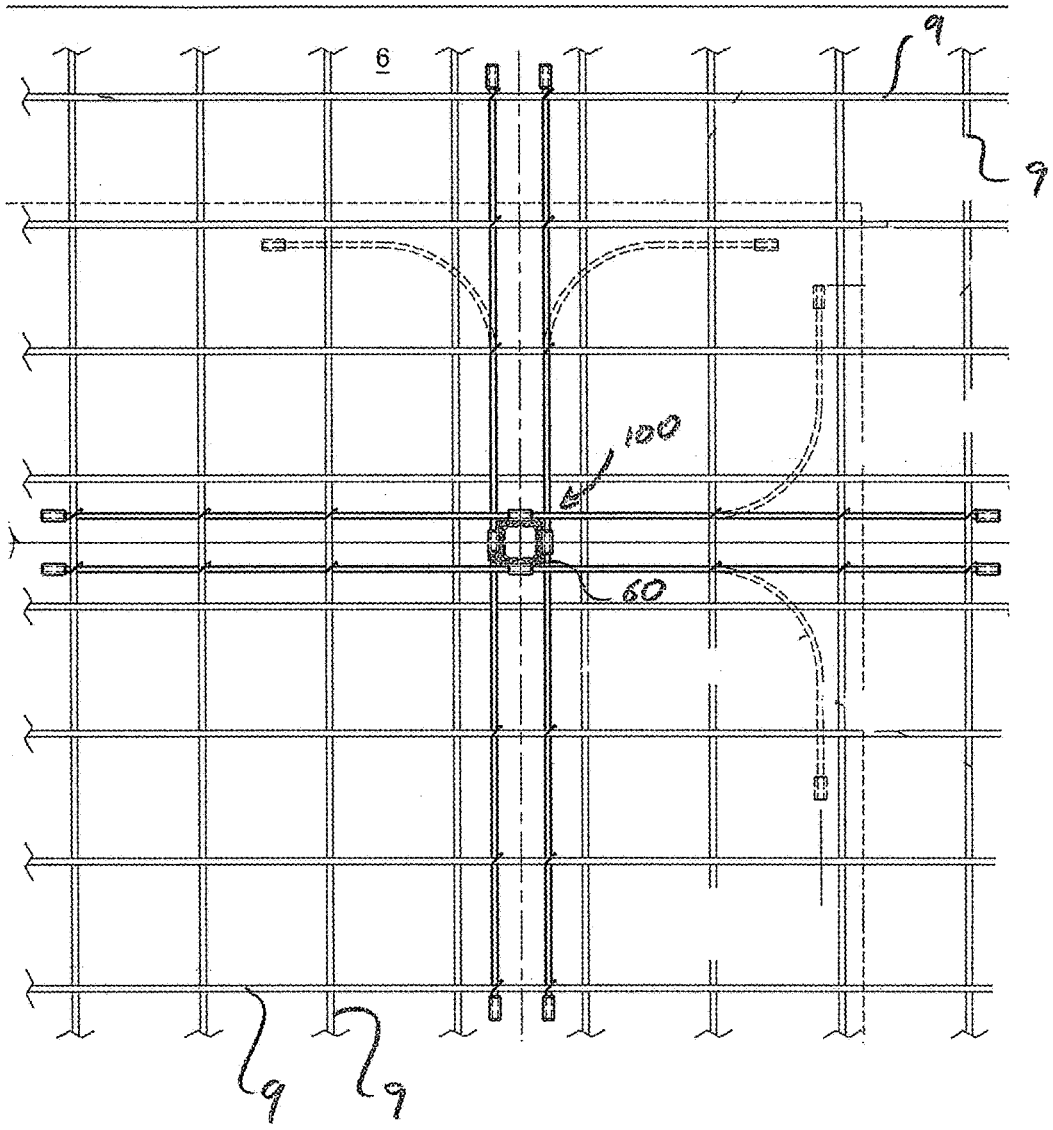
FIG. 8 is a top plan view of the apparatus of FIG. 2 secured to reinforcing bars in a concrete slab.

Turning now to FIG. 7, a single tensile member 90 is illustrated. The tensile member 90 is formed of an elongate rod or flexible steel cable extending between first and second ends, 92 and 94, respectively. Each elongate member 90 has a substantially elongate portion 96. The substantially elongate portions 96 may have an arcuate bend as seen in FIG. 8 which will be described in more detail below.

As illustrated in FIG. 7, the tensile members 90 may include an enlarged portion 106 proximate to each of the first and second ends 92 and 94. The enlarged portion 106 having inner and outer surface 108, 110 extending radially from the tensile member 90 for providing an anchor point within the concrete slab 12 when installed. The elongate members 90 may be formed of any material capable of distributing the any forces exerted upon the jacket member 60 to the surrounding concrete. By way of non-limiting example, the elongate members 90 may be formed of steel, stainless steel, aluminum or alloys thereof and in particular may be formed of rebar. Enlarged portions 106 are sufficiently sized to prevent tensile member 90 from being pulled all the way through bore 71 of connector 69. Accordingly, having enlarged portion 106 at either end 92, 94, tensile member 90 is slidably captured by tensile member connector 69. Advantageously, tensile members 90 may be slidably adjusted to some degree (relative to jacket member 60 (e.g. so as to position a particular tensile member 90 closer to a particular section of rebar, as may be desirable when forming the concrete slab 12).

As illustrated in FIG. 2, the plurality of tensile members 90 are preferably arranged within a concrete slab 12 to form a central cage, surrounding the jacket member 60 and extending through the sleeves 69. As illustrated in FIGS. 2 and 4, the elongate members may be also optionally arranged in first and second planes, generally indicated at 104 and 105, respectively wherein the first plane 104 is located proximate to the top end 62 of the jacket member 60 and the second plane 105 is located proximate to the bottom end 64 of the jacket member 60. Advantageously, by providing multiple elongate tensile members 90 in more than one plane 104,105 of the concrete slab 12, any forces experienced by the fall arrest barrier 10 of the present invention are transmitted into a greater area and volume of concrete slab 12, thereby reducing the risk of cracking or of a post anchor dislodging from such a slab 12.

Figure 5:
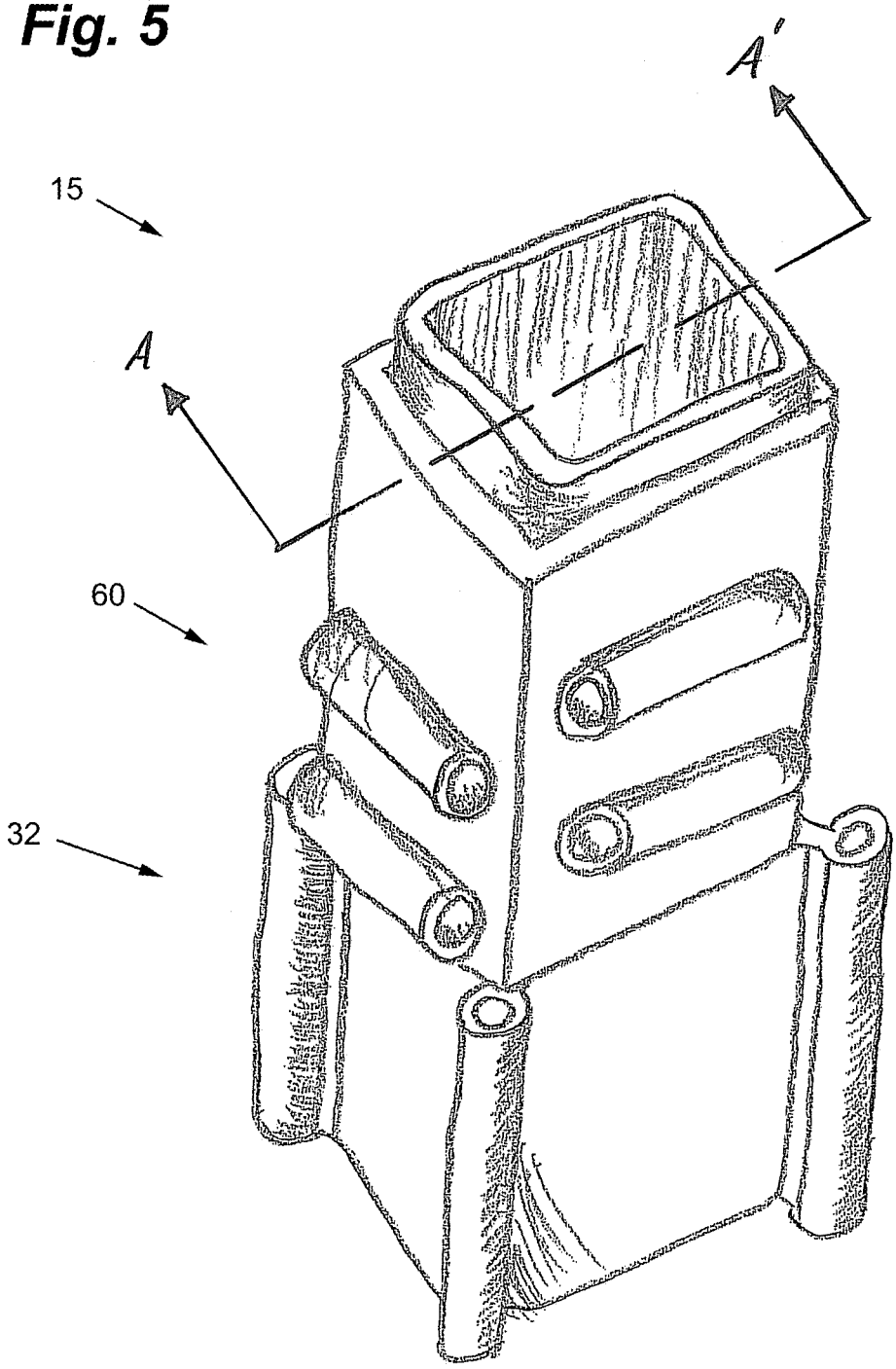
FIG. 5 is a perspective view of the socket nested within the jacket member in an embodiment of the present invention.

In operation, and having reference to FIG. 6, when forming a concrete slab 12, the socket 32 may be positioned on a bottom form 6 at a location desired for the post and secured thereto by fasteners 7 through the fastener bores 46. Thereafter the jacket member 60 may be slidably positioned over the sleeve portion 34 wherein the bottom end of the jacket member 64 abuts against shoulder 49 of the base portion 44. As illustrated in FIG. 8, a grid of rebar 9 may be distributed above the form 6 as is commonly known in the art. A plurality of tensile members 90 may then be arranged to form the central cage 100 which is located about the jacket member 60. As illustrated in FIG. 5, the tensile members 90 may be secured to each other and optionally to the rebar 9 by ties as are commonly known in the art. As the concrete is poured over the bottom form 6, the jacket member 60 may be lifted to expose the at least one opening 51 in the sleeve portion 34 of the socket 32 for providing a conduit for concrete to fill at least some of the base portion 44 of the socket 32 (see FIG. 6). Once the base portion 44 is filled with concrete, the jacket member 60 may be returned to position, abutted against the shoulder 49 of the base portion 44 of the socket 32. The jacket member 60 may be friction fit to the sleeve portion 34 of the socket 32 and assisted by a splint 79 for creating an additional force between the inner wall of the jacket member 60 and the outer wall of the sleeve portion 34 of the socket 32 (see FIG. 6).

In use, a post 14 may be slidably located within the central cavity 40. As set out above, the post 14 is retained within the central cavity 40 by friction in an interference fit. The post 14 may optionally include a pry plate as are commonly known in the art to facilitate removal therefrom. Advantageously, should a force be transmitted from the fall arrest barrier 10 into post 14, jacket member 60, along with the one or more tensile members 90 will act to disperse such force across a greater area/volume of concrete as would otherwise be the case in conventional embedded post anchors. More advantageously, a post 14 retained by a post anchor 15 of the present invention and which experiences large forces and is now more likely to simply bend (e.g. see FIG. 11), rather than crack the surrounding concrete or even dislodge therefrom, as is the case with prior art post anchors. Even more advantageously, if post 14 simply bends, then the functioning of the fall arrest barrier is not really affected and a user 8 is more likely to be saved thereby (as compared to cases wherein a prior art post anchor and post may have entirely dislodged from the concrete slab 12).

Those of ordinary skill in the art will appreciate that various modifications to the invention as described herein will be possible without falling outside the scope of the invention. In the claims, the word "comprising" is used in its inclusive sense and does not exclude other elements being present. The indefinite article "a" before a claim feature does not exclude more than one of the features being present.

What is claimed is:

1. A post anchor (15) for securing a post (14) within a poured concrete slab 12, the post anchor comprising:

a socket (32) having a first cavity (40) sized to receive the post (14) therein;

a jacket member (60) adapted to mount over at least a portion of the socket (32); and at least one tensile member (90) mounted to, and extending from, the jacket member (60);

wherein the socket (32) further comprises a sleeve portion (34) and a base portion (44);

wherein the sleeve portion (34) is formed of a wall (38) and defines the first cavity (40) therein;

wherein the first cavity (40) extends from a top end (36) of the sleeve portion (34) to a floor (37);

wherein the socket (32) further comprises a second cavity (41) provided between the floor (37) and a bottom end (50) of the base portion (44);

wherein the base portion (44) further comprises a shoulder (49) between the floor (37) and bottom end (50); and wherein, when the jacket member (60) is fully mounted over the sleeve portion (34), the jacket member (60) engages the shoulder (49).

2. A post anchor (15) for securing a post (14) within a poured concrete slab (12), the post anchor comprising:

a socket (32) having a first cavity (40) sized to receive the post (14) therein;

a jacket member (60) adapted to mount over at least a portion of the socket (32); and at least one tensile member (90) mounted to, and extending from, the jacket member (60);

wherein the socket (32) further comprises a sleeve portion (34) and a base portion (44);

wherein the sleeve portion (34) is formed of a wall (38) and defines the first cavity (40) therein;

wherein the first cavity (40) extends from a top end (36) of the sleeve portion (34) to a floor (37);

wherein the socket (32) further comprises a second cavity (41) provided between the floor (37) and a bottom end (50) of the base portion (44);

wherein the socket (32) further comprises at least one opening (51) through the sleeve portion (34) into the second cavity (41) for allowing concrete or cement to flow therethrough and into said second cavity (41).

* * * * *